US008118566B2

(12) United States Patent
Takahashi et al.

(10) Patent No.: US 8,118,566 B2
(45) Date of Patent: Feb. 21, 2012

(54) PISTON COMPRESSOR WITH SECOND INTAKE

(75) Inventors: Tomoyasu Takahashi, Saitama (JP); Yoshihiro Adachi, Saitama (JP)

(73) Assignee: Valeo Thermal Systems Japan Corporation, Saitama (JP)

( * ) Notice: Subject to any disclaimer, the term of this patent is extended or adjusted under 35 U.S.C. 154(b) by 494 days.

(21) Appl. No.: 12/311,622

(22) PCT Filed: Oct. 23, 2007

(86) PCT No.: PCT/JP2007/070598

§ 371 (c)(1),
(2), (4) Date: Apr. 7, 2009

(87) PCT Pub. No.: WO2008/056533

PCT Pub. Date: May 15, 2008

(65) Prior Publication Data

US 2010/0034672 A1 Feb. 11, 2010

(30) Foreign Application Priority Data

Nov. 9, 2006 (JP) ..... 2006-303559

(51) Int. Cl.
*F04B 27/08* (2006.01)

(52) U.S. Cl. ..... 417/269; 417/270; 417/271; 92/12; 92/13.3; 92/71

(58) Field of Classification Search ..... 417/269, 417/242, 283, 285, 288, 296
See application file for complete search history.

(56) References Cited

U.S. PATENT DOCUMENTS

2004/0197202 A1* 10/2004 Saiki et al. ..... 417/269
2005/0244278 A1* 11/2005 Hayashi et al. ..... 417/222.2

OTHER PUBLICATIONS

International Search Report mailed Nov. 27, 2007.

* cited by examiner

*Primary Examiner* — Anne Hines
*Assistant Examiner* — Jacob Stern
(74) *Attorney, Agent, or Firm* — Rader, Fishman & Grauer PLLC

(57) ABSTRACT

In a piston-type compressor in which a working fluid is taken in through an intake port is first compressed with pistons and is then let out through an outlet port, an axial hole ranging along the axial direction and a radial hole communicating with the axial hole and opening into a crankcase are formed within the shaft. Additionally, a first intake passage through which the working fluid having flowed in through the intake port is guided via the crankcase to the radial hole and the axial hole and a second intake passage through which the working fluid having flowed in through the intake port is guided to join the working fluid having been drawn into the first intake passage by bypassing the crankcase are formed in the compressor. The working fluid is taken into cylinders from the area where the first working fluid and the second working fluid join each other.

10 Claims, 8 Drawing Sheets

(a)

(b)

PISTON COMPRESSOR WITH SECOND INTAKE

TECHNICAL FIELD

The present invention relates to a piston-type compressor with a structural feature that makes it possible to separate oil from the working fluid in a working fluid passage within the compressor, and more specifically, it relates to a compressor that includes a working fluid passage through which the working fluid having been taken in through an intake port is guided to an intake chamber via a crankcase, is compressed with a piston and is then let out through an outlet port via an outlet chamber.

BACKGROUND ART

If oil is allowed to flow out of the compressor used in a refrigerating cycle to an outside cycle, problems such as insufficient oil present in the compressor and lowered refrigerating efficiency due to the oil circulating through the cycle together with the coolant.

Various structures have been proposed in the related art to address these problems. For instance, there is a structure proposed in the related art, which includes an oil separation chamber disposed on the outlet side of the compressor to communicate with the outlet chamber and an oil separation tube disposed in the oil separation chamber so as to separate oil present in the compressed coolant by causing the coolant containing the oil around the oil separation tube (patent reference literature 1)

In addition, there is a compressor with a working fluid passage through which the working fluid (coolant) is guided from the intake port into the intake chamber via a crankcase (swashplate chamber), adopting a structure that includes an oil separation plate installed in the crankcase (swashplate chamber) and separates/captures the oil mixed in the working fluid by causing the working fluid having flowed into the crankcase from the intake port to collide with the oil separation plate (patent reference literature 2).

The applicant of the present invention also previously proposed a compressor in which the working fluid is a guided from the intake port into the intake chamber via a crankcase. The compressor adopts a structure that includes at least an axial hole ranging along the axis of a shaft passing through the crankcase, and a radial hole ranging along the radius of the shaft so as to open into the crankcase, both formed in the shaft, with the working fluid having flowed into the crankcase guided into the intake chamber sequentially via at least the radial hole and the axial hole, so as to separate the oil in the working fluid that is about to flow from the crankcase into the intake chamber as the working fluid flows through the radial hole opening into the crankcase by using the centrifugal separation effect induced as the shaft rotates.

Patent reference literature 1: Japanese Unexamined Patent Publication No. 2005-23847

Patent reference literature 2: Japanese Unexamined Patent Publication No. 2000-45938

DISCLOSURE OF THE INVENTION

Problems to be Solved by the Invention

While the compressor with part of the working fluid passage constituted with the radial hole and the axial hole formed at the shaft so as to separate the oil mixed in the working fluid as the working fluid flows through the radial hole through the centrifugal separation effect induced by the rotation of the shaft, achieves advantages such as a reduction in the number of required parts and better ease with which the compressor is assembled since there is no need to install a special oil separation mechanism in the compressor, the following issue has been clarified through further research conducted by the applicant.

Namely, if all the working fluid having flowed in through the intake port is to pass through the radial hole and the axial hole formed at the shaft to be guided into the intake chamber, the flow velocity of the working fluid increases at the entrance to the radial hole at the shaft, which leads to a failure in achieving the full centrifugal separation effect with some of the oil in the working fluid carried into the intake chamber. As a result, the quantity of oil flowing out of the compressor cannot be reduced to the full extent.

In particular, if the compressor is equipped with a double-headed pistons, the volumetric capacity of the crankcase is bound to be small and the relatively small crankcase size resulting in a smaller clearance between the pistons and the shaft and a smaller interval between the individual pistons make it difficult to reduce the flow velocity near the radial hole relative to a given working fluid intake flow rate. In addition, depending upon the specific shapes of the holes formed at the shaft, the passage resistance may be significant. While these concerns may be addressed by increasing the volumetric capacity of the crankcase and forming the holes (the axial hole and the radial hole) at the shaft in shapes that will reduce the resistance, these measures will lead to an increase in the dimensions of the compressor.

A primary object of the present invention, having been completed by reflecting upon the issues discussed above, is to provide a piston-type compressor that assures effective centrifugal separation through shaft rotation and makes it possible to effectively minimize the quantity of oil flowing out of the compressor without having to install a complicated oil separation mechanism.

Means for Solving the Problems

In order to achieve the object described above, the inventor of the present invention et al. have completed the present invention based upon a finding that the oil in the working fluid can be separated more readily as the working fluid passes through the radial hole opening into the crankcase through effective centrifugal separation achieved through the rotation of the shaft by reducing the flow rate of the working fluid flowing into the shaft from the crankcase.

Namely, the piston-type compressor according to the present invention comprise a housing, pistons that reciprocally slide within cylinders formed at the housing, a shaft that passes through a crankcase formed inside the housing and is rotatably supported at the housing, a swashplate that is housed inside the crankcase and is caused to rotate by the rotation of the shaft to induce reciprocal movement of the pistons and an intake port and an outlet port both formed at the housing through which a working fluid is taken in and is let out, with the working fluid having been taken in through the intake port guided into the cylinders to be compressed by the pistons and then let out through the outlet port. The piston-type compressor is characterized in that it includes at least an axial hole formed in the shaft to range along the axial direction and a radial hole communicating with the axial hole and ranging along the radial direction at the shaft to open into the crankcase, that the compressor includes a first intake passage through which the working fluid having flowed in through the intake port is guided to the radial hole and the axial hole via the crankcase and a second intake passage through which the working fluid having flowed in through the intake port travels by bypassing the crankcase to join the working fluid having been guided into the first intake passage and that the working fluid is taken into the cylinders from an area where the first working fluid and the second working fluid join each other.

In addition to the first intake passage through which the working fluid is guided from the intake port to the crankcase and then from the crankcase to the axial hole at the shaft, the second intake passage through which the working fluid from the intake port travels by bypassing the crankcase to join the working fluid having been guided into the first intake passage is formed. As a result, a relative reduction in the quantity of working fluid guided into the crankcase is achieved, which, in turn, makes it possible to reduce the flow velocity of the working fluid to pass through the radial hole formed at the shaft. Ultimately, a full centrifugal effect is achieved through the shaft rotation, ensuring that the oil mist in the working fluid becomes separated to remain in the crankcase instead of being drawn out of the crankcase.

The working fluid may be taken into the cylinders from the area where the first working fluid and the second working fluid join each other in a mode adopted in conjunction with a reed valve type compressor by forming the joining area as an intake chamber disposed at the housing, forming the first intake passage as a passage through which the working fluid having flowed in through the intake port travels through the radial hole and the axial hole sequentially to be guided into the intake chamber via the crankcase and forming the second intake passage as a passage through which the working fluid having flowed in through the intake port is guided directly into the intake chamber by bypassing the crankcase, or in a mode adopted in conjunction with a rotary valve type compressor by forming the joining area as the axial hole at the shaft, forming the first intake passage as a passage through which the working fluid having flowed in through the intake port is guided from the crankcase to the axial hole via the radial hole and forming the second intake passage as a passage through which the working fluid having flowed in through the intake port is guided to the axial hole at the shaft without traveling through the crankcase.

Namely, the former structure adopted in a piston-type compressor comprising a housing, pistons that reciprocally slide within cylinders formed at the housing, a crankcase, an intake chamber and an outlet chamber all formed in the housing, a shaft that passes through the crankcase and is rotatably supported at the housing, a swashplate that is housed inside the crankcase and is caused to rotate by the rotation of the shaft to induce reciprocal movement of the pistons and an intake port and an outlet port both formed at the housing through which a working fluid is taken in and is let out, with the working fluid having been taken in through the intake port guided into the intake chamber to be compressed by the pistons and then let out through the outlet port via the outlet chamber, is characterized in that it includes at least an axial hole formed in the shaft to range along the axial direction and a radial hole communicating with the axial hole and ranging along the radial direction at the shaft to open into the crankcase, that the compressor includes a first intake passage through which the working fluid having flowed into the crankcase is guided into the intake chamber after traveling through the radial hole and the axial hole sequentially and a second intake passage through which the working fluid having flowed in through the intake port is guided directly into the intake chamber by bypassing the crankcase and that the working fluid is taken into the cylinders from the intake chamber.

In addition to the first intake passage through which the working fluid is guided from the intake port to the crankcase and then through the shaft to be guided into the intake chamber, the second intake passage through which the working fluid is directly guided into the intake chamber from the intake port by bypassing the crankcase is formed. As a result, a relative reduction in the quantity of working fluid guided into the crankcase is achieved, which, in turn, makes it possible to reduce the flow velocity of the working fluid passing through the radial hole formed at the shaft. Ultimately, a full centrifugal effect is achieved through the shaft rotation, ensuring that the oil mist in the working fluid becomes separated to remain in the crankcase instead of being drawn out of the crankcase.

The latter structure adopted in a piston-type compressor comprising a housing, pistons that reciprocally slide within cylinders formed at the housing, a crankcase, an intake chamber and an outlet chamber all formed in the housing, a shaft that passes through the crankcase and is rotatably supported at the housing, a swashplate that is housed inside the crankcase and is caused to rotate by the rotation of the shaft to induce reciprocal movement of the pistons and an intake port and an outlet port both formed at the housing through which a working fluid is taken in and is let out, with the working fluid having been taken in through the intake port first compressed with the pistons and then let out through the outlet port via the outlet chamber, is characterized in that it includes at least an axial hole formed in the shaft to range along the axial direction and a radial hole communicating with the axial hole and ranging along the radial direction at the shaft to open into the crankcase, that the compressor includes a first intake passage through which the working fluid having flowed in through the intake port first flows into the crankcase and is then guided to the axial hole via the radial hole and a second intake passage through which the working fluid having flowed in through the intake port is guided to the axial hole via the intake chamber by bypassing the crankcase and that the working fluid is taken into the cylinders from the axial hole.

In addition to the first intake passage through which the working fluid is guided from the intake port to the crankcase and then from the crankcase to the axial hole at the shaft, the second intake passage through which the working fluid is guided from the intake port to the axial hole at the shaft via the intake chamber by bypassing the crankcase is formed. As a result, a relative reduction in the quantity of working fluid guided into the crankcase is achieved, which, in turn, makes it possible to reduce the flow velocity of the working fluid passing through the radial hole formed at the shaft. Ultimately, a full centrifugal effect is achieved through the shaft rotation, ensuring that the oil mist in the working fluid becomes separated to remain in the crankcase instead of being drawn out of the crankcase.

While the quantity of working fluid flowing into the crankcase is reduced with a second intake passage in place and thus, the velocity of the working fluid flowing through the radial hole at the shaft is reduced, it is desirable that a restricting means for regulating the quantity of working fluid flowing through the first intake passage to a value smaller than the value of the quantity of working fluid flowing through the second intake passage be installed so as to assure a full oil separation effect through centrifugal separation induced as the shaft rotates by lowering the velocity to a full extent.

It is particularly desirable that such restricting means be constituted with a restricting portion disposed at the first intake passage with a restricting effect equivalent to a restricting effect of a passage section set in a range that does not exceed an equivalent of a hole of approximately 7 mm in diameter or a passage section that does not exceed an equivalent of a hole of approximately 7 mm in diameter. For instance, a restricting effect equivalent to that of a passage section equivalent to 7 mm in diameter may be achieved by disposing a plurality of restricting areas equivalent to 8 mm in diameter in series. In addition, the restricting means may regulate the quantity of the working fluid flowing through the first intake passage so that it does not exceed approximately 30% of the overall quantity of working fluid taken into the compressor.

Furthermore, in order to prevent the oil mist in the crankcase from flowing out through the entrance of the crankcase, the restricting means may be disposed in the first intake passage at an upstream position relative to the crankcase. In particular, if the housing includes a plurality of housing members defining the crankcase, the restricting means may be formed over an area where the housing members are joined or it may be formed by removing part of a gasket disposed between the housing members.

Alternatively, the restricting means may be formed by constructing at least either the radial hole or the axial hole.

Effect of the Invention

As explained above, according to the present invention, the intake passage in a compressor into which the working fluid flows from the intake port via the crankcase is constituted with the first intake passage through which the working fluid having flowed into the crankcase is guided to the radial hole and the axial hole formed at the shaft and the second intake passage through which the working fluid having flowed in through the intake port travels by bypassing the crankcase to join the working fluid having been guided into the first intake passage. As a result, a relative reduction in the flow velocity of the working fluid flowing through the radial hole at the shaft opening into the crankcase is achieved and reliable oil separation is achieved through the centrifugal separation effect induced as the shaft rotates. In other words, the quantity of oil flowing out of the compressor can be effectively reduced without having to install a complicated oil separation mechanism. In addition, since the working fluid bypasses the crankcase and is directly guided into the intake chamber through the second intake passage, the problem of the oil mist in the crankcase being drawn out through the second intake passage is eliminated.

In particular, a restricting means for regulating the quantity of working fluid flowing through the first intake passage to a value smaller than the value of the quantity of working fluid flowing through the second intake passage may be installed. Such a restricting means may be a restricting portion disposed at the first intake passage ranging over a passage section set within a range that does not exceed an equivalent of approximately 7 mm in diameter or a restricting portion achieving a restricting effect equivalent to that of a passage section that does not exceed an equivalent of approximately 7 mm in diameter. Alternatively, the restricting means may assume a structure that allows it to regulate the quantity of working fluid flowing through the first intake passage so that it does not exceed approximately 30% of the quantity of all the working fluid taken into the compressor. The restricting means assuming any of these structures will assure full oil separation through centrifugal separation induced as the shaft rotates can be assured by reducing the velocity of the working fluid flowing through the radial hole at the shaft opening into the crankcase.

Furthermore, the restricting means may be disposed at the first intake passage at an upstream position relative to the crankcase by forming it over an area where the plurality of housing members defining the crankcase join each other or by removing part of the gasket disposed between the housing members to form the restricting means. In such a case, the oil mist in the crankcase is not allowed to flow out through the entrance of the crankcase. Since the restricting means in this structure can be formed simply by assembling the housing members to constitute the housing, no special assembly operation is required to form the restricting means.

Moreover, the restricting means may be formed by constricting at least either the radial hole or the axial hole at the shaft and, in such a case, a relative reduction in the outer diameter of the shaft is achieved.

EXPLANATION OF REFERENCE NUMERALS

Figure 1:
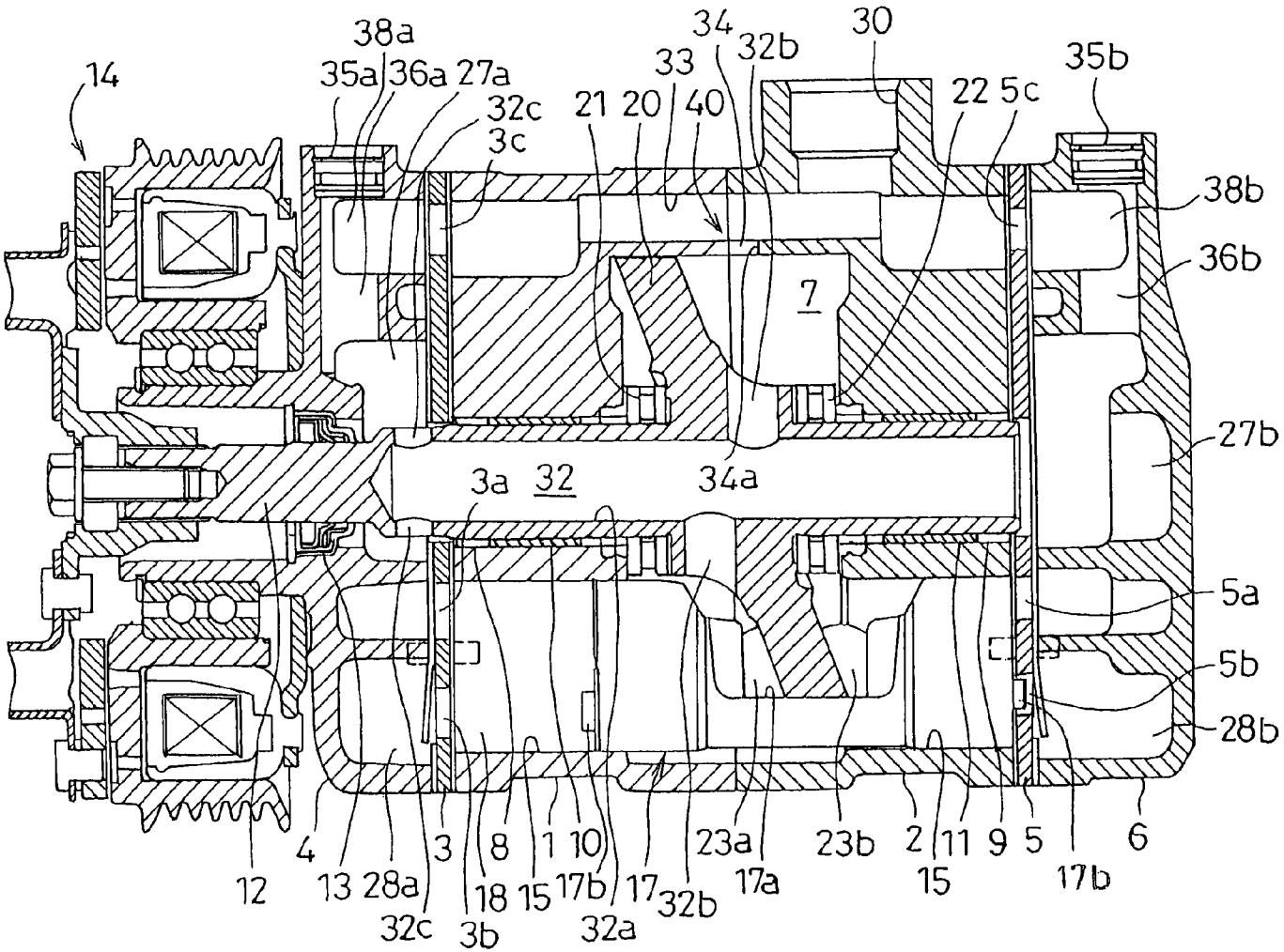
FIG. 1 is a sectional view presenting an example of a structure that may be adopted in the piston-type compressor according to the present invention.
Figure 2:
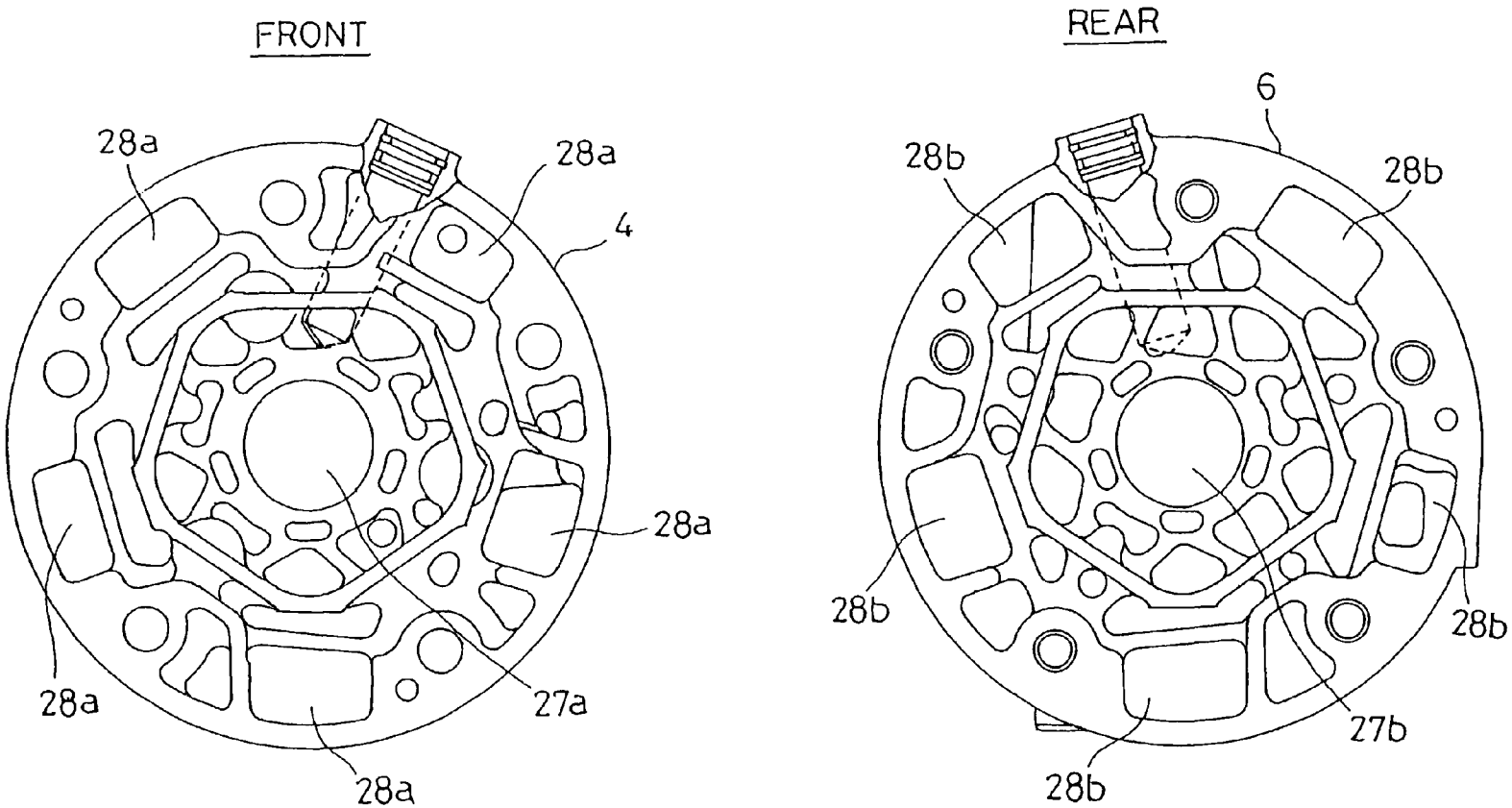
FIG. 2 shows the front head and the rear head in the piston-type compressor according to the present invention viewed from the cylinder block side.

1 front-side cylinder block
2 rear-side cylinder block
4 front head
6 rear head
7 crankcase
12 shaft
15 cylinder
17 piston
20 swashplate
27*a*, 27*b* intake chamber
28*a*, 28*b* outlet chamber

30 intake port
31 outlet port
32*a* axial hole
32*b* inflow-side radial hole
32*c* outflow-side radial hole
40 restricting portion
41 gasket
50 rotary valve

BEST MODE FOR CARRYING OUT THE INVENTION

The following is an explanation of the best mode for carrying out the present invention, given in reference to the attached drawings.

FIG. 1 shows a piston-type compressor widely referred to as a fixed-capacity swashplate reciprocating compressor, which is used in a refrigerating cycle with a working fluid constituted with a coolant circulating therein.

The compressor comprises a front-side cylinder block 1, a rear-side cylinder block 2 mounted at the front-side cylinder block 1, a front head 4 that is mounted on the front side (the left side in the figure) of the front-side cylinder block 1 via a valve plate 3, and a rear head 6 that is mounted on the rear side (the right side in the figure) of the rear-side cylinder block 2 via a valve plate 5. The front head 4, the front-side cylinder block 1, the rear-side cylinder block 2 and the rear head 6, fastened together along the axial direction with a fastening bolt, constitute the housing for the compressor.

Inside the front-side cylinder block 1 and the rear-side cylinder block 2, a crankcase 7 defined by assembling the cylinder blocks together is present. In the crankcase 7, a shaft 12, which is rotatably supported via bearings 10 and 12 at shaft supporting holes 8 and 9 respectively formed at the front-side cylinder block 1 and the rear-side cylinder block 2, with one end thereof projecting out beyond the front head 4, is disposed. The bearings 10 and 11 are mounted at positions at which they do not block the openings at radial holes in a shaft internal passage formed within the shaft. In addition, a sealing member 13 disposed between the front end of the shaft 12 and the front head 4 prevents coolant leakage, and an electromagnetic clutch 14 is mounted at the front end of the shaft 12 projecting out beyond the front head 4.

In the space within the cylinder blocks 1 and 2, a plurality of cylinders 15 are formed parallel to the shaft supporting holes 8 and 9 over equal intervals on the circumference of a circle ranging around the shaft. Inside each cylinder 15, a double-headed piston 17 with a head portion formed at each of the two ends thereof is inserted so as to slide reciprocally within the cylinder, with compression spaces defined between the double-headed piston 17 and the valve plate 3 and between the double-headed piston 17 and the valve plate 5.

A swashplate 20 housed within the crankcase 7, which rotates together with the shaft 12, is formed as an integrated part of the shaft 12.

The swashplate 20 is rotatably supported via thrust bearings 21 and 22 at the front-side cylinder block 1 and the rear-side cylinder block 2, and its peripheral edge is retained at a retaining recess 17*a* formed over a central area of each double-headed piston 17 via a pair of semi-spherical shoes 23*a* and 23*b* disposed so as to hold the peripheral edge from the front and from behind. Accordingly, as the shaft 12 rotates and thus the swashplate 20, too, rotates, the rotating motion is converted to reciprocal motion of the double-headed piston 17 via the shoes 23*a* and 23*b*, resulting in a change in the volumetric capacities of the compression spaces 18.

At the valve plate 3 and 5, intake holes 3*a* and 5*a*, which are opened/closed via intake valves constituted with the reed valves installed at the valve plate end surfaces further toward the cylinder block, and outlet holes 3*b* and 5*b*, which are opened/closed via outlet valves constituted with reed valves installed at the valve plate end surfaces further toward the cylinder heads, are formed in correspondence to each cylinder. In addition, at the ends of each double-headed piston 17, projections 17*b* that can be inserted at the corresponding outlet holes 3*b* and 5*b* are formed at positions corresponding to the positions of the outlet holes 3*b* and 5*b* at the valve plates 3 and 5. An intake chamber 27*a*, where the coolant to be delivered into the compression spaces 18 is stored and outlet chambers 28*a*, where the coolant let out from compression spaces 18 is stored, are formed at the front head 4. An intake chamber 27*b*, where the coolant to be delivered into the compression spaces 18 is stored, and outlet chambers 28*b*, where the coolant let out from the compression spaces 18 is stored, are formed at the rear head 6. In the example presented in the figure, the intake chambers 27*a* and 27*b* are both formed over substantially central areas of the corresponding heads 4 and 6, whereas the outlet chambers 28*a* and 28*b* are formed around the corresponding intake chambers 27*a* and 27*b*.

At the rear-side cylinder block 2 constituting part of the housing, an intake port 30 through which the coolant is taken in from an external cycle and an outlet port 31 communicating with the outlet chambers 28*a* and 28*b*, through which compressed coolant is let out, are formed.

The intake passage extending from the intake port 30 to the intake chambers 27*a* and 27*b* in this structural example is constituted with a first intake passage extending to the intake chambers 27*a* and 27*b* at the front head 4 and the rear head 6 through the crankcase 7 communicating with the intake port 30 and a shaft internal passage 32 formed at the shaft 12 passing through the crankcase 7 and a second intake passage through which the coolant having flowed in through the intake port 30 is directly guided to the intake chambers 27*a* and 27*b* without traveling through the crankcase 7.

More specifically, an axial passage 33 extending along the axial direction to connect with the intake port 30 is formed outside the crankcase 7, and the first intake passage is formed by forming a passing hole 34 in the axial passage 33 so as to communicate with the crankcase 7 and by forming in the shaft 12 an axial hole 32*a* with the opening thereof ranging from the rear side toward the front side along the axial direction and the open end on the rear-side end opening into the intake chamber 27*b* located at the rear head 6, an inflow-side radial hole 32*b* communicating with the axial hole 32*a* and ranging along the radial direction in the shaft 12 to open into the crankcase 7 and an outflow-side radial hole 32*c* communicating with the axial hole 32*a* ranging along the radial direction in the shaft 12 to open into the intake chamber 27*a* formed at the front head 4. Part of the coolant having been taken in through the intake port 30 flows into the crankcase 7 through the passing hole 34 and then is guided to the intake chambers 27*a* and 27*b* located at the front and the rear of the compressor via the axial hole 32*a*, the inflow-side radial hole 32*b* and the outflow-side radial hole 32*c* constituting the shaft internal passage 32 at the shaft 12.

The second intake passage is formed by extending the axial passage 33 formed outside the crankcase 7 to reach the front head 4 and the rear head 6, allowing the extended passage to communicate via passing holes 3*c* and 5*c* formed at the valve plates 3 and 5 with drawing chambers 38*a* and 38*b* formed at the front head 4 and the rear head 6, forming radial passages 36*a* and 36*b* at the front head 4 and the rear head 6 with the openings thereof ranging from the outside along the radial direction so as not to interfere with the outlet chambers 28*a* and 28*b* at the front head 4 and the rear head 6 and the opening ends thereof closed off with closing members 35*a* and 35*b*, and connecting the drawing chambers 38*a* and 38*b* with the intake chambers 27*a* and 27*b* via the radial passages 36*a* and 36*b* so as to guide part of the coolant having been taken in through the intake port 30 to the intake chambers 27*a* and 27*b* at the front and the rear of the compressor by bypassing the crankcase 7, allowing the coolant to join the coolant having been guided through the first intake passage. The passage section of the second intake passage is equal to or greater than an equivalent of a hole of 10 mm in diameter large enough to tolerate the pressure loss satisfactorily from the viewpoint of required performance.

In the intake passage structured as described above, a restricting portion 40, which regulates the quantity of coolant flowing through the first intake passage to a value smaller than the value of the quantity of coolant flowing through the second intake passage, is installed in the first intake passage. In the embodiment, the restricting portion 40 is disposed at an upstream position relative to the crankcase 7 in the first intake passage, e.g., over an area where the front-side cylinder head 1 and the rear-side cylinder head 2 are abutted, to constitute the housing.

Figure 3:
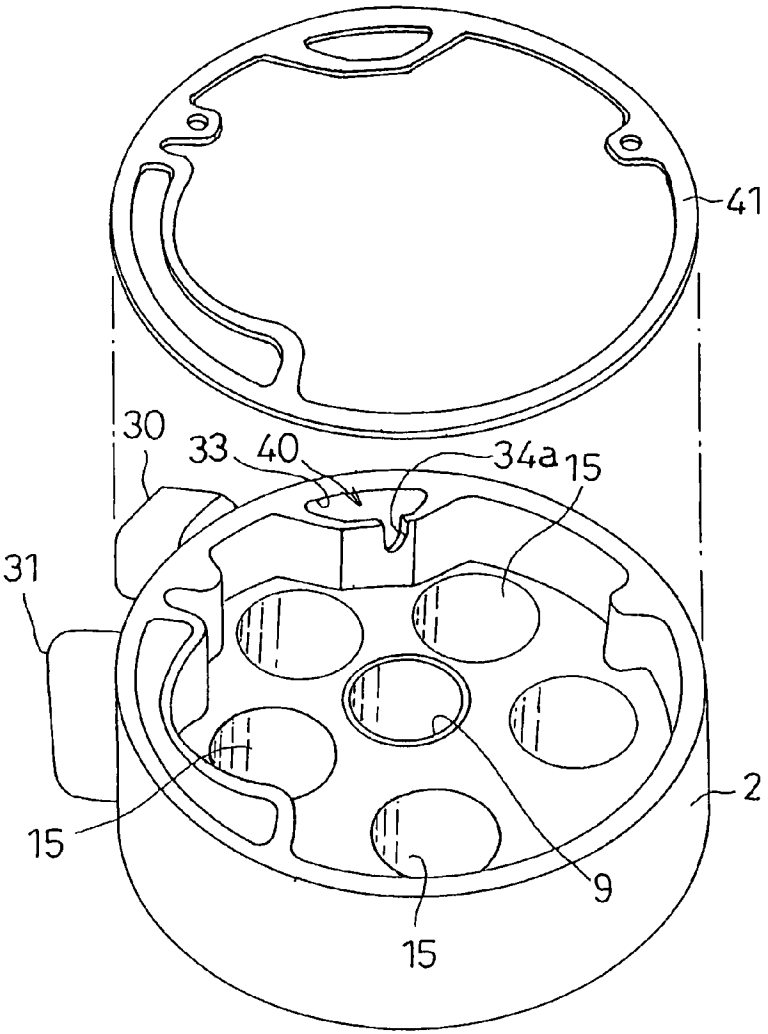
FIG. 3 provides illustrations of a rear-side cylinder block in reference to which an example of a structure adopted in the restricting portion is described, with FIG. 3(*a*) showing the rear-side cylinder block and the bracket in an exploded perspective and FIG. 3(*b*) showing the rear-side cylinder block viewed from the front-side cylinder block side.
Figure 3:
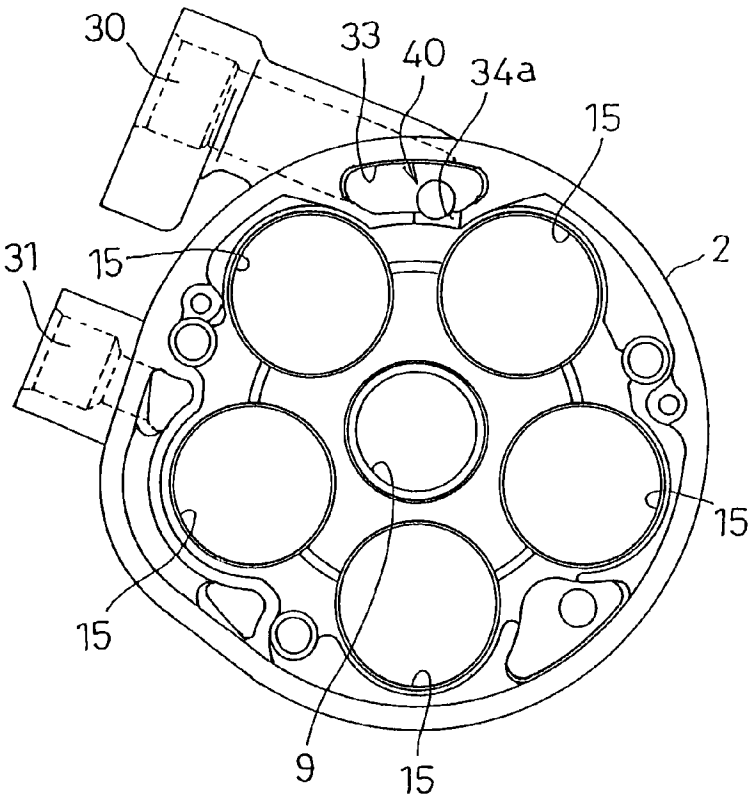

More specifically, a U-shaped notch 34*a* is formed at least one of the abutting surfaces of the front-side cylinder head 1 and the rear-side cylinder head 2, i.e., at least one of the abutting surfaces of the walls defining the axial passage 33 connected with the intake port 30 (the abutting surface of the wall defining the axial passage 33 at the rear-side cylinder head 2 in this example, as shown in FIG. 3) and the passing hole 34 is formed as the front-side cylinder head 1 and the rear-side cylinder head 2 are attached to each other via a gasket 41 with the passing hole 34 having an opening such that the quantity of coolant flowing through the first intake passage is smaller than the quantity of coolant flowing through the second intake passage.

Since the restricting portion 40 constituted with the passing hole 34 is present in the first intake passage, the quantity of coolant flowing into the crankcase 7 is reduced, which, in turn, reduces the flow velocity with which the coolant passes through the inflow-side radial hole 32*b* at the shaft 12, assuring full oil separation from the coolant having flowed into the crankcase 7 through the centrifugal separation effect induced as the shaft 12 rotates. In addition, since the restricting portion 40 assumes a size that regulates the quantity of coolant flowing through the first intake passage to a value smaller than the value of the quantity of coolant flowing through the second intake passage, the centrifugal separation effect mentioned above is provided with an even higher level of reliability.

Furthermore, since the restricting portion 40 is present at an upstream position relative to the crankcase 7 in the first intake passage, the relative flow velocity of the coolant picks up at the area around the crankcase entrance and, as a result, oil having been agitated inside the crankcase is not allowed to flow out through the entrance area of the crankcase 7. Since the restricting portion 40 is formed over the area where the front-side cylinder block 1 and the rear-side cylinder block 2 are abutted with each other (the restricting portion is formed at the abutting end surface of the rear-side cylinder block 2, the restricting portion 40 can be formed simply by assembling the front-side cylinder block 1 and the rear-side cylinder block 2 via the gasket 41, eliminating the need for a special assembly operation for restricting means formation.

The coolant having been taken in through the intake port 30 is then taken into the intake chambers 27*a* and 27*b* directly through the second intake passage by bypassing the crankcase 7, becomes compressed while still containing oil and is let out to the outside of the compressor in the refrigerating cycle in the compressed state. However, as this coolant circulates through the refrigerating cycle and is taken back into the compressor, part of it will be distributed into the first intake passage to undergo oil separation. Thus, as this process is repeated, oil circulating in the refrigerating circuit becomes separated with a high level of reliability and is retained in the crankcase.

It is to be noted that the pistons 17 each include projections 17*b* that are allowed to project through the outlet holes 3*b* and 5*b*, formed at the ends thereof at positions corresponding to the positions of the outlet holes 3*b* and 5*b* at the valve plates 3 and 5. As a result, the dead volume in the outlet holes 3*b* and 5*b* at the valve plates 3 and 5 (the remaining volumetric capacity in the compression spaces not used for outlet when the pistons assume the top dead center point, is reduced, which makes it possible to minimize the extent to which the performance is compromised due to re-expansion of the compressed gas.

According to research findings obtained by the inventor, the flow velocity at the inflow-side radial hole 32*b* at the shaft 12 is optimally controlled to avoid a reduction in the oil separation performance by forming the passing hole 34 constituting the restricting portion 40 in the first intake passage so that its passage section does not exceed an equivalent of a hole of approximately 7 mm in diameter and regulating the quantity of coolant flowing through the first intake passage so that it does not exceed approximately 30% of the entire quantity of coolant flowing in through the intake port 30 (the entire quantity of coolant taken into the compressor). The findings indicate that the presence of such a restricting portion ultimately allows oil to be retained in the crankcase 7 with a high level of reliability.

According to an estimate made by the inventor of the present invention et al., a restricting portion equivalent to a hole of approximately 7 mm in diameter must be disposed in the first intake passage in order to distribute coolant into the first intake passage in a quantity equivalent to approximately 30% of the entire quantity of coolant taken into a compressor used in an automotive air-conditioning system, and a restricting portion equivalent to a hole of approximately 5 mm in diameter must be disposed in the first intake passage in order to distribute coolant into the first intake passage in a quantity equivalent to approximately 20% of the entire quantity of coolant taken into the compressor and a restricting portion equivalent to a hole of approximately 3 mm in diameter must be disposed in the first intake passage in order to distribute coolant into the first intake passage in a quantity equivalent to approximately 10% of the entire quantity of coolant taken into the compressor. In addition, through computation, the inventor of the present invention has determined that the quantities of coolant flowing through the first intake passage and the second intake passage are substantially equal to each other when a restricting portion equivalent to a hole of approximately 12 mm in diameter is formed at the first intake passage.

Figure 4:
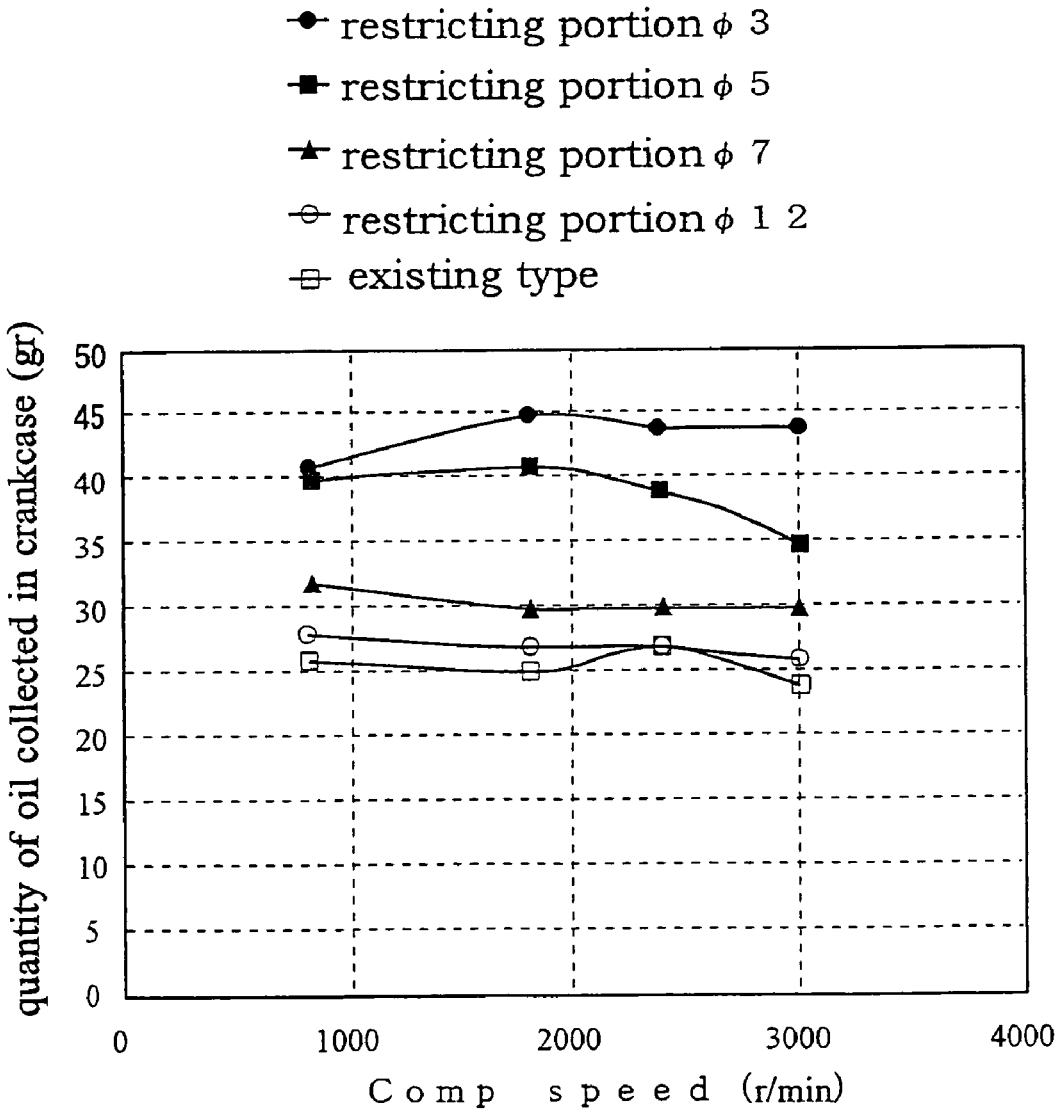
FIG. 4 is a characteristics diagram showing the relationship between the quantity of oil collected inside the crankcase and the rotation rate at the compressor, investigated by adjusting the size of the restriction in the compressor adopting the structure according to the present invention with the relationship observed in a compressor in the related art also indicated for purposes of comparison.

Based upon these findings, the quantity of oil having been collected in the crankcase after operating the compressor according to the present invention was investigated by connecting the compressor in the refrigerating cycle in an automotive air-conditioning system and adjusting the rotation rate of the compressor and the hole-equivalent diameter at the restricting portion, and the investigation results shown in FIG. 4 were obtained.

As these results clearly indicate, compared with the structure in the related art (existing type) which does not include the second intake passage or the restricting portion 40 and guides the gas having been taken into the intake chambers 27*a* and 27*b* via the crankcase 7 and the shaft internal passage 32 in its entirety, better oil separation through centrifugal separation is achieved with the quantity of coolant flowing into the crankcase 7 reduced by an extent corresponding to the quantity of coolant directly guided to the intake chambers 27*a* and 27*b* through the second intake passage in the compressor according to the present invention, which includes the second intake passage and the restricting portion at the first intake passage assuming a hole equivalent diameter of 12 mm in diameter. However, the quantity of coolant traveling through the crankcase 7 is still significant and, since the flow velocity of the coolant flowing through the inflow-side radial hole 32*b* at the shaft 12 is not reduced sufficiently, a significant difference from the related art cannot be observed in part of the rotation rate range.

When the passage section of the restricting portion 40 is equal to or less than that of a hole of approximately 7 mm in diameter, even a small difference in the passage section is confirmed to greatly affect the quantity of oil collected in the crankcase. While the quantity of oil collected in the crankcase is not significantly different from that in the compressor in the related art when the restricting portion has a passage section equal to or greater than that of a hole of approximately 7 mm in diameter and thus, only a slight improvement over the related art is achieved with such a restricting portion, the flow velocity of coolant flowing through the inflow-side radial hole 32*b* at the shaft 12 is reduced to a sufficient extent to promote the process of oil separation through the centrifugal separation effect induced as the shaft rotates and increase the quantity of oil collected in the crankcase if the restricting portion 40 is formed over a passage section equal to or less than that of a hole of approximately 7 mm in diameter. Accordingly, it is desirable that the restricting portion 40 be set over a range that does not exceed the passage section of a hole of 7 mm in diameter (equal to or less than the passage section of a hole of 7 mm in diameter) or to set it over a range over which the ratio of the quantity of coolant flowing through the first intake passage to the entire quantity of coolant does not exceed approximately 30% (the range over which the ratio is approximately 30% or less).

In addition, as the graph clearly indicates, the oil can be separated and held with a higher level of stability when the passage section of the restricting portion 40 is smaller. However, if the restricting portion 40 is too small, the quantity of coolant passing through the crankcase 7 also becomes much smaller and, as a result, the areas where the swashplate 20 slides against the shoes 23*a* and 23*b* will not be cooled to a sufficient extent. Also, if the oil in the crankcase 7 is carried out of the compressor for some reason, it will take a long time to retrieve the oil into the crankcase 7. For these reasons, the lower limit value to the size of the restricting portion 40 should be selected by taking into consideration the required cooling effect to be achieved over the sliding areas, the acceptable length of time required for oil collection and the like.

Figure 5:
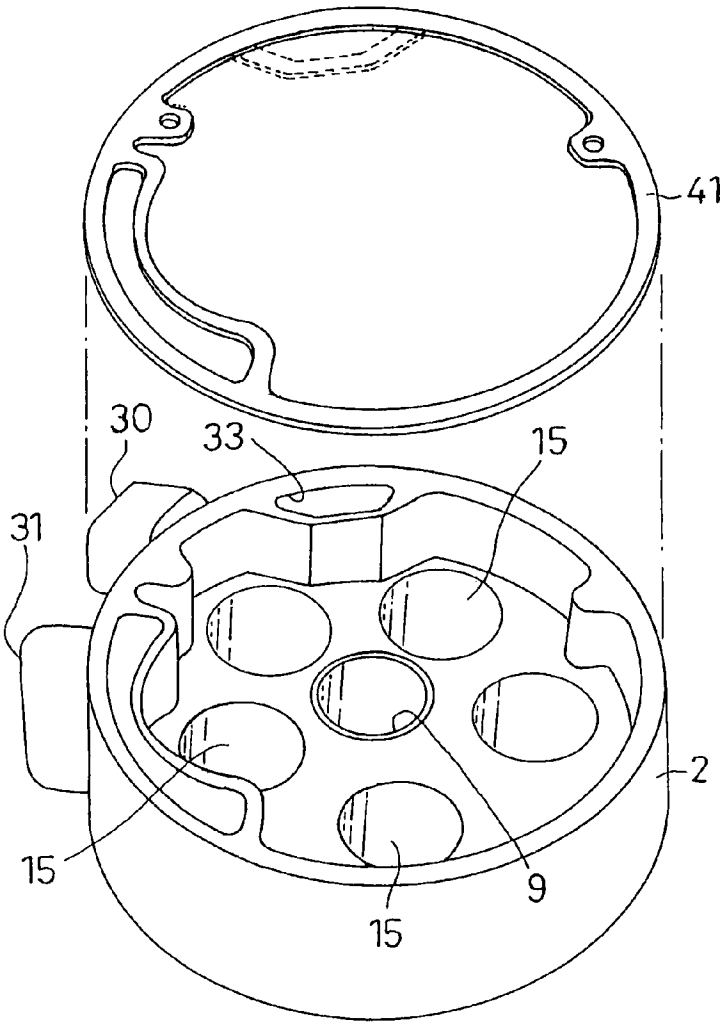
FIG. 5 provides illustrations of a rear-side cylinder block in reference to which another example of a structure that may be adopted in the restricting portion is described, with FIG. 5(*a*) showing the rear-side cylinder block and the bracket in an exploded perspective and FIG. 5(*b*) showing the rear-side cylinder block viewed from the front-side cylinder block side with the hatched area indicating the area coming into contact with the gasket.
Figure 5:
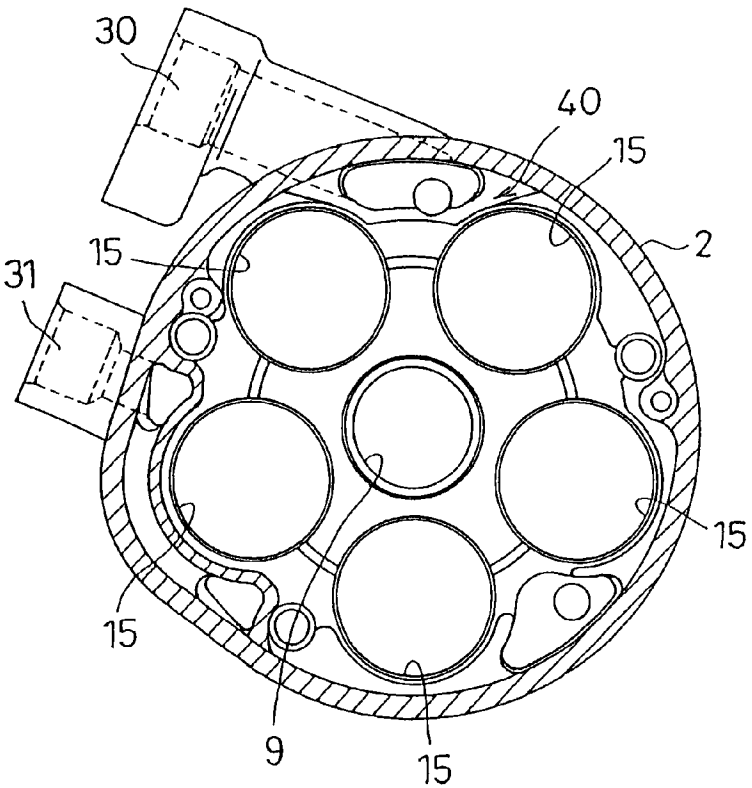

It is to be noted that while the restricting portion 40 located at an upstream-side position relative to the crankcase 7 is formed by notching the wall at the abutting surface of the cylinder block 1 or 2 constituting the housing in the structure described above, the passing hole 34 opening into the crankcase 7 may be formed at the wall at a position other than the abutting surface. In addition, instead of forming the passing hole 34 at the wall of a cylinder block, the restricting portion 40 may be constituted with a clearance formed between the front-side cylinder block 1 and the rear-side cylinder block 2 (the portion between the axial passage 33 and the crankcase 7, which does not come into contact with the gasket. The area that comes into contact with the gasket is hatched in FIG. 5(*b*)) by removing the gasket 41 disposed between the front-side cylinder block 1 and the rear-side cylinder block 2 over an area where the space between the axial passage 33 and the crankcase 7 is sealed (indicated by the dotted lines in the figure), as shown in FIG. 5.

Figure 6:
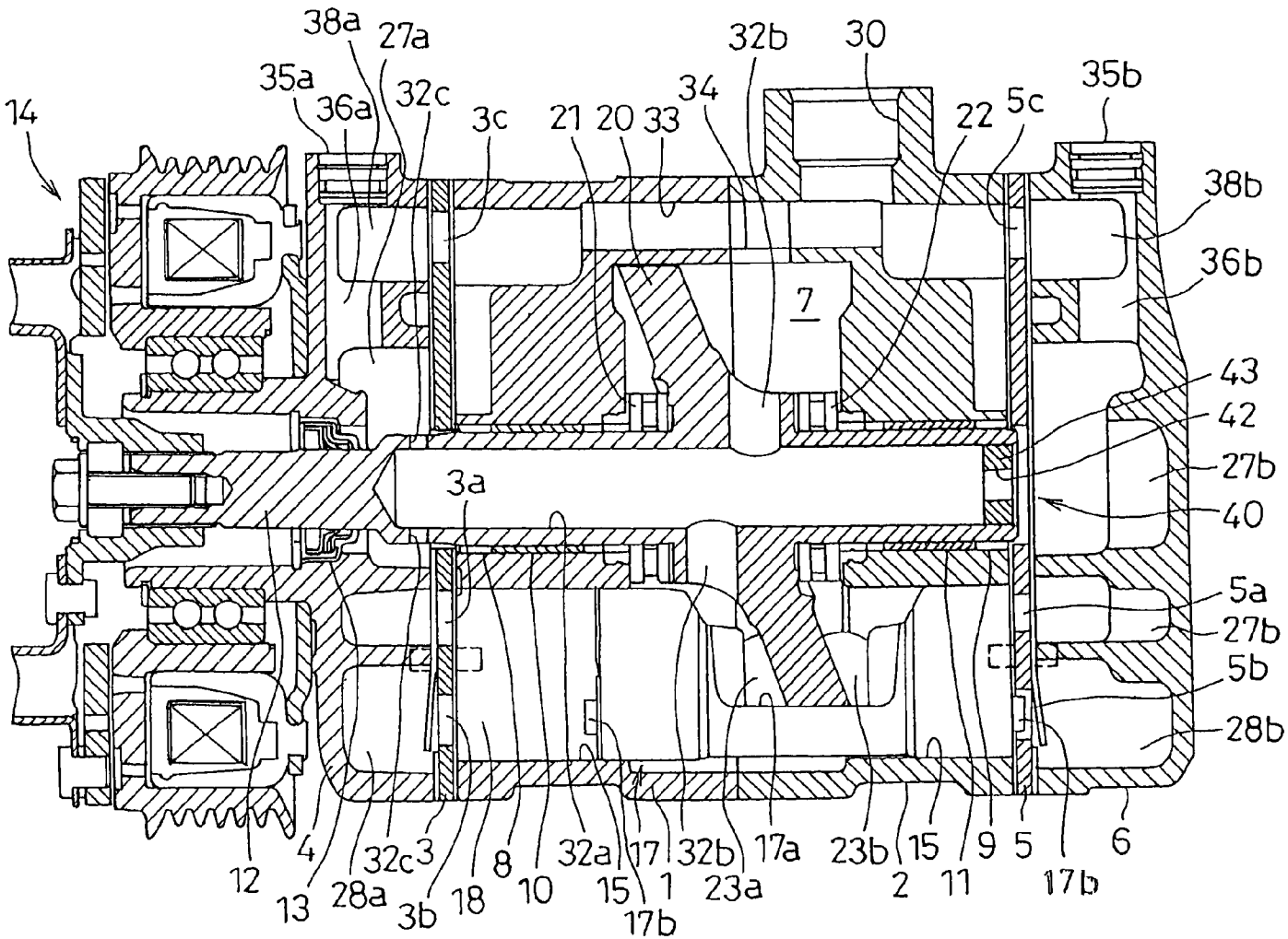
FIG. 6 is a sectional view of an example of a structure that may be adopted in a piston-type compressor with the restricting portion thereof assuming an alternative structure.

In addition, while the restricting portion 40 is formed at an upstream-side position relative to the crankcase 7 in the first intake passage in the structural example described above, a restricting portion may be formed at the shaft internal passage 32. For instance, as shown in FIG. 6, a fitting member 43 with a restricting hole 42 formed therein may be mounted at an end of the axial hole 32*a* at the shaft 12 opening into the intake chamber 27*b* at the rear head 6 so as to constrict the space between the crankcase 7 and the intake chamber 27*b* at the rear head 6, and the diameter of the outflow aside radial hole 32*c* may be reduced so as to also constrict the space between the crankcase 7 and the intake chamber 27*a* at the front head 4.

Figure 7:
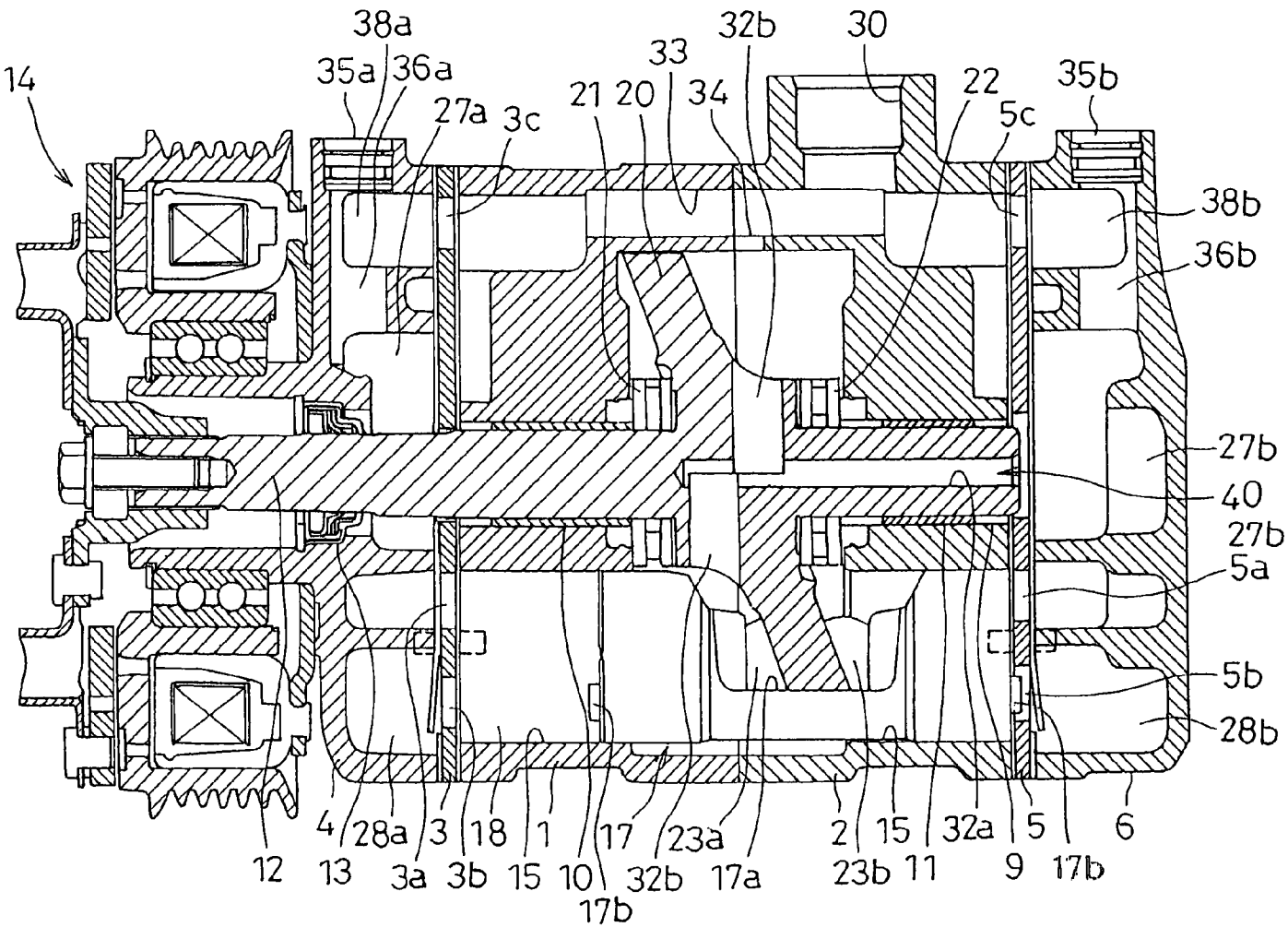
FIG. 7 is a sectional view of an example of a structure that may be adopted in a piston-type compressor with the restricting portion thereof assuming another alternative structure.

Alternatively, the axial hole 32*a* at the shaft 12 may be made to communicate with the intake chamber 27*b* at the rear head 6 alone without communicating with the intake chamber 27*a* at the front head 4 and the diameter of the axial hole 32*a* at the shaft 12 may also be reduced to constrict the space between the crankcase 7 and the intake chamber 27*b* at the rear head 6, as shown in FIG. 7.

It is to be noted that regardless of which structure is adopted, the quantity of coolant flowing through the first intake passage should be regulated so that it does not exceed approximately 30% of the entire quantity of coolant flowing in through the intake port 30 (the entire quantity of coolant taken into the compressor) by setting the quantity of coolant to flow through the first intake passage smaller than the quantity of coolant to flow through the second intake passage and better still, by setting the passage section of the restricting portion 40 over a range that does not exceed the passage section of a hole of approximately 7 mm in diameter.

In addition, the restricting portion 40 formed at the first intake passage may have a single constricting portion or it may be formed by adopting the individual structures described above in combination, e.g., a plurality of restricting portions equivalent to holes with 8 mm in diameter may be formed in series to achieve an effect comparable to that of a restricting portion with a passage section equivalent to that of a hole of 7 mm in diameter. For this reason, the restricting portion with a restricting effect equivalent to that of a hole of 7 mm in diameter or smaller may assume a structure that achieves a restricting effect equal to that achieved over a passage section that does not exceed the passage section of a hole of approximately 7 mm in diameter as well as a structure achieved by setting the passage section of the restricting area over an area that does not exceed an equivalent of a hole of approximately 7 mm in diameter.

While an explanation is given above in reference to the embodiment on an example in which the present invention is adopted in a piston type fixed capacity compressor equipped with double-headed pistons, the present invention may be equally effectively adopted in a fixed capacity compressor in which single-headed pistons are engaged in reciprocal sliding motion via a swashplate, the tilt angle of which relative to the shaft is fixed.

In the piston-type compressor described above, the coolant is drawn into the compression spaces 18 defined in the cylinders 15 via a mechanism that opens/closes the intake holes 5*a* with intake valves constituted with reed valves, the mechanism through which the coolant is drawn into the compression spaces 18 may instead be constituted with rotary valves 50.

Figure 8:
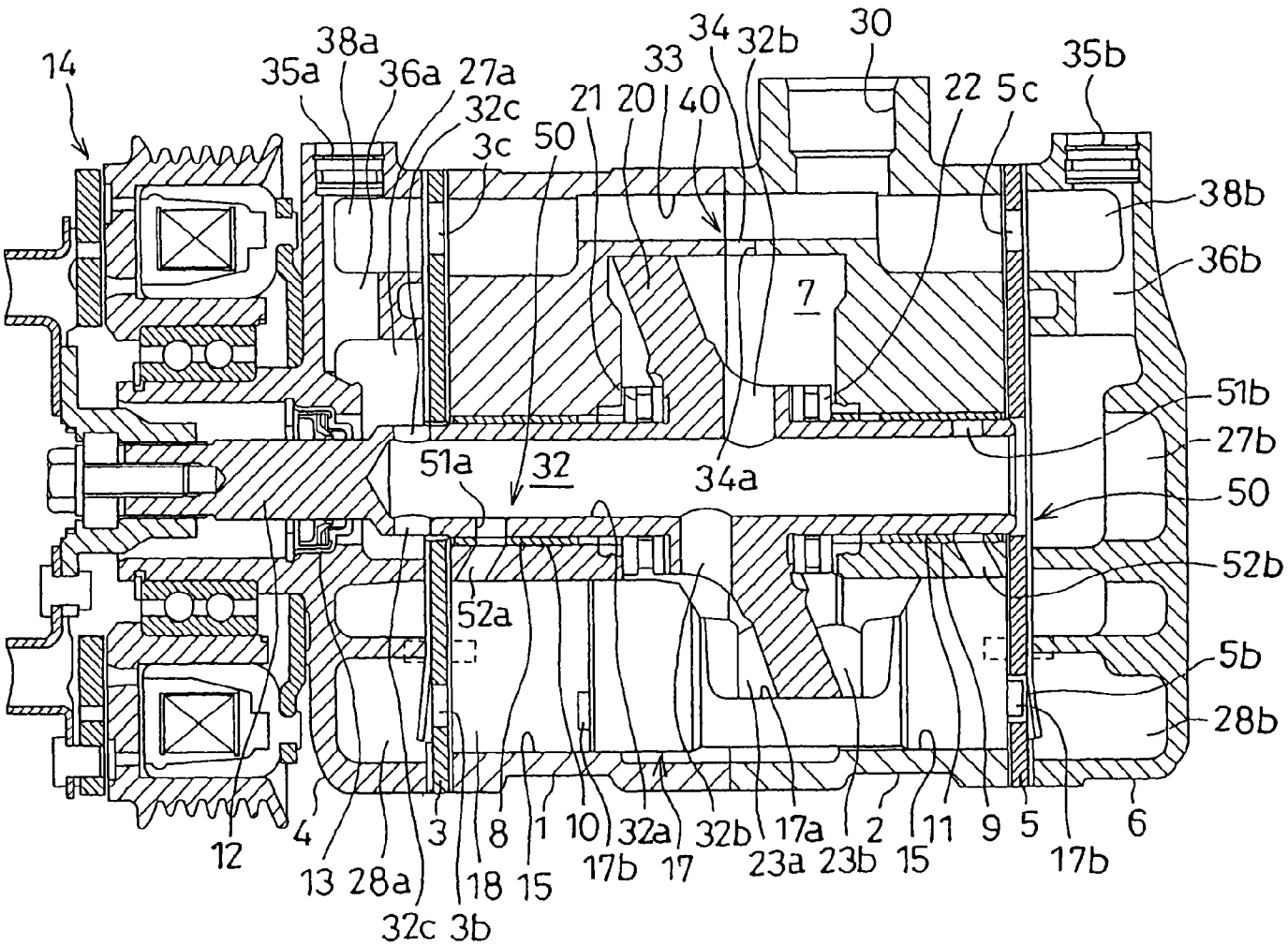
FIG. 8 is a sectional view showing another example of a structure that may be adopted in the piston-type compressor according to the present invention.

FIG. 8 shows a piston-type compressor which includes rotary valves 50. The structure adopted in this compressor is described below by focusing on the differences from the compressor explained earlier, with the same reference numerals assigned to identical components so as to preclude the necessity for a repeated explanation thereof.

The rotary valves 50 used in this piston-type compressor, each formed by the shaft 12 and the cylinder blocks supporting the shaft (the front-side cylinder block 1 and the rear-side cylinder block 2), are formed in correspondence to the individual cylinder blocks 1 and 2. Distribution holes 51*a* and 51*b* communicating with the axial hole 32*a* connecting with the intake chambers 27*a* and 27*b* are formed at the shaft 12 to range along the radial direction and drawing holes 52*a* and 52*b*, with ends thereof on one side made to intermittently communicate with the distribution holes 51*a* and 51*b* via the bearings 10 and 11 and the ends thereof on the other side made to communicate with the cylinders 15, are formed in correspondence to the individual cylinders.

Since the distribution holes 51*a* and 51*b* are formed at the shaft 12, the distribution holes 51*a* and 51*b* come into communication with the drawing holes 52*a* and 52*b* synchronously with the reciprocal motion of the pistons 17, i.e., the distribution holes come into communication with the drawing holes during the intake stroke of the pistons. Accordingly, during the intake stroke, the coolant present in the axial hole at the shaft 12 travels through the distribution holes 51*a* and 51*b* and the drawing holes 52*a* and 52*b* to be taken into the compression spaces 18 at the cylinders 15, whereas during the outlet stroke, the communication between the distribution holes 51*a* and 51*b* and the drawing holes 52*a* and 52*b* is cut off and the coolant having been taken into the compression spaces 18 becomes compressed by the pistons 17. It is to be noted that intake holes which are opened/closed via intake valves are not formed at the valve plates 3 and 5.

In this structure, the passage through which the coolant is drawn into the compression spaces 18 defined within the cylinders 15 is constituted with the distribution holes 51*a* and 51*b* and the drawing holes 52*a* and 52*b* at the rotary valves 50. In other words, the first intake passage extending to the rotary valves 50 is constituted with the intake port 30->the passing hole 34->the crankcase 7->the inflow side radial hole 32*b*->the axial hole 32*a*, whereas the second intake passage is constituted with the intake port 30->the drawing chambers 38*a* and 38*b*->the intake chambers 27*a* and 27*b*->the axial hole 32*a*. The coolant guided through the first intake passage by traveling through the crankcase 7 and the coolant guided through the second intake passage by bypassing the crankcase 7 join each other at the axial hole 32*a* at the shaft 12, and the combined flow of coolant is then guided to the compression spaces 18 via the distribution holes 51*a* and 51*b* and the drawing holes 52*a* and 52*b* at the rotary valves 50 during the intake stroke. It is to be noted that other structural features are identical to those in the structural example explained earlier with coolant caused to flow through the first intake passage in a smaller quantity than the coolant to flow through the second intake passage. A restricting portion with a structure similar to one of the structures explained earlier may be disposed within the applicable range.

This structure, too, reduces the quantity of coolant flowing into the crankcase 7 to lower the flow velocity of the coolant traveling through the inflow-side radial hole 32*b* at the shaft 12 and, as a result, the coolant containing oil having flowed into the crankcase 7 undergoes thorough oil separation through the centrifugal separation effect induced as the shaft 12 rotates. In addition, by forming the restricting portion 40 in a specific size at which the quantity of coolant flowing through the first intake passage is smaller than the quantity of coolant flowing through the second intake passage, the centrifugal separation effect described above can be provided with an even higher level of reliability. All in all, this alternative structure assures advantages similar to those of the structural example explained earlier.

It is to be noted that while the mechanism through which the coolant is drawn into the compression spaces 18 is constituted with intake valves or rotary valves both on the front side and on the rear side in the examples explained above, the front-side mechanism and the rear-side mechanism may adopt different structures with, for instance, intake valves used on one side and rotary valves used on the other side.

The invention claimed is:

1. A piston-type compressor, comprising:

a housing;

pistons that reciprocally slide within cylinders formed at said housing;

a shaft that passes through a crankcase formed inside said housing and is rotatably supported at said housing;

a swashplate that is housed inside said crankcase and is caused to rotate by the rotation of said shaft to induce reciprocal movement of said pistons; and an intake port and an outlet port both formed at said housing through which a working fluid is taken in and is let out, with working fluid having been taken in through said intake port guided into said cylinders to be compressed by said pistons and then let out through said outlet port, characterized in:

that said compressor includes at least an axial hole formed in said shaft to range along the axial direction and a radial hole communicating with said axial hole and ranging along the radial direction at said shaft to open into said crankcase;

that said compressor includes a first intake passage through which working fluid having flowed in through said intake port is guided to said radial hole and said axial hole via said crankcase and a second intake passage through working fluid having flowed in through said intake port travels by bypassing said crankcase to join working fluid having been guided into said first intake passage; and that working fluid is taken into said cylinders from a joining area where first working fluid and second working fluid join each other.

2. A piston-type compressor according to claim 1, characterized in:

that the joining area is formed as an intake chamber disposed at said housing, through said first intake passage, working fluid having flowed in through said intake port travels through said radial hole and said axial hole sequentially to be guided into said intake chamber via said crankcase, and through said second intake passage working fluid having flowed in through said intake chamber is guided directly into said intake chamber by bypassing said crankcase.

3. A piston-type compressor according to claim 1, characterized in:

that the joining area is formed at said axial hole at the shaft through said first intake passage working fluid having flowed in through said intake port is guided from said crankcase to said axial hole via said radial hole and through said second intake passage as a passage through which working fluid having flowed in through said intake port is guided to said axial hole at said shaft without traveling through said crankcase.

4. A piston-type compressor according to any of claims 1 through 3, further comprising:

a restricting means for regulating the quantity of working fluid flowing through said first intake passage so that the quantity of working fluid to flow through said first intake passage is smaller than the quantity of working fluid to flow through said second intake passage.

5. A piston-type compressor according to claim 4, characterized in: that said restricting means is constituted with a restricting portion disposed at said first intake passage achieving a restricting effect equivalent to a restricting effect of a passage section set in a range that does not exceed an equivalent of a hole of approximately 7 mm in diameter or a passage section that does not exceed an equivalent of a hole of approximately 7 mm in diameter.

6. A piston-type compressor according to claim 4, characterized in:

that the restricting means regulates the quantity of working fluid flowing through said first intake passage so that the quantity does not exceed approximately 30% of the overall quantity of working fluid taken into said compressor.

7. A piston-type compressor according to claim 4, characterized in:

that said restricting means is disposed at an upstream position relative to said crankcase in said first intake passage.

8. A piston-type compressor according to claim 7, characterized in:

that said housing includes a plurality of housing members defining said crankcase and said restricting means is formed over an area where said housing members are joined together.

9. A piston-type compressor according to claim 7, characterized in:

that housing includes a plurality of housing members defining set crankcase and said restricting means is formed by removing part of a gasket disposed between said housing members.

10. A piston-type compressor according to claim 4, characterized in:

that said restricting means is formed by constricting at least either said radial hole or said axial hole.

* * * * *